US010312030B2

(12) United States Patent
Yen et al.

(10) Patent No.: US 10,312,030 B2
(45) Date of Patent: Jun. 4, 2019

(54) ILLUMINATED KEYPAD MODULE WITH LIMITED LIGHT LEAKAGE

(71) Applicants: LITE-ON ELECTRONICS (GUANGZHOU) LIMITED, Guangzhou (CN); Lite-On Technology Corporation, Taipei (TW)

(72) Inventors: Ming-Fu Yen, Taipei (TW); Chen-Yu Tsai, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/867,712

(22) Filed: Jan. 11, 2018

(65) Prior Publication Data

US 2019/0096600 A1 Mar. 28, 2019

(30) Foreign Application Priority Data

Sep. 22, 2017 (CN) ..... 2017 1 0863656

(51) Int. Cl.

| | |
|---|---|
| ***H01H 13/83*** | (2006.01) |
| ***H01H 13/705*** | (2006.01) |
| ***H01H 13/10*** | (2006.01) |
| ***H01H 13/14*** | (2006.01) |

(52) U.S. Cl.

CPC ..... *H01H 13/10* (2013.01); *H01H 13/14* (2013.01); *H01H 13/705* (2013.01); *H01H 13/83* (2013.01); *H01H 2219/054* (2013.01)

(58) Field of Classification Search

CPC . H01H 13/83; H01H 13/705; H01H 2219/054
See application file for complete search history.

(56) References Cited

U.S. PATENT DOCUMENTS

2018/0254156 A1* 9/2018 Yang ..... H01H 13/83

FOREIGN PATENT DOCUMENTS

TW M400023 3/2011

* cited by examiner

*Primary Examiner* — Vanessa Girardi
(74) *Attorney, Agent, or Firm* — JCIPRNET

(57) ABSTRACT

A keypad module, including a bottom plate, a circuit film, a plurality of barricades, an elastic body, a scissor mechanism and a keycap. The circuit film is disposed on the bottom plate and includes a switch. The barricades are disposed upright on the circuit film and surrounds the switch. The elastic body is disposed on the switch. The scissor mechanism is fixed on the bottom plate and disposed at a position close to the switch on the circuit film. The keycap is fixed on the scissor mechanism and covers the switch, the elastic body, the scissor mechanism and the barricades.

9 Claims, 5 Drawing Sheets

ILLUMINATED KEYPAD MODULE WITH LIMITED LIGHT LEAKAGE

CROSS REFERENCE TO RELATED APPLICATION

This application claims the priority benefit of China application serial no. 201710863656.X, filed on Sep. 22, 2017. The entirety of the above-mentioned patent application is hereby incorporated by reference herein and made a part of specification.

BACKGROUND OF THE INVENTION

Field of the Invention

The invention is related to a keypad module, and particularly to a keypad module that can effectively improve light leakage.

Description of Related Art

Currently, a light-emitting keyboard or a light-emitting key are commonly seen. A light-emitting element is, for example, disposed on the light-emitting keyboard or the bottom of the light-emitting key. The light emitted by the light-emitting element can be transmitted through from a partially transparent keycap to achieve the visual effect.

However, in the known light-emitting keyboard or the light-emitting key, the light is not only transmitted through from a light transmitting portion of the keycap, but is also leaked from a gap under the keycap, which is glare that interferes user's view. It is an object for persons of the field to find out a solution to the light leakage problem mentioned above.

SUMMARY OF THE INVENTION

The invention provides a keypad module which may effectively improve light leakage.

In the invention, the keypad module includes a bottom plate, a circuit film, a plurality of barricades, an elastic body, a scissor mechanism and a keycap. The circuit film is disposed on the bottom plate and includes a switch. The barricades are disposed upright on the circuit film and surrounds the switch. The elastic body is disposed on the switch. The scissor mechanism is fixed on the bottom plate and disposed at a position close to the switch on the circuit film. The keycap is fixed on the scissor mechanism and covers the switch, the elastic body, the scissor mechanism and the barricades.

In an embodiment of the invention, the barricades are formed via punching the circuit film to be formed integrally with the circuit film.

In an embodiment of the invention, the keypad module further includes a soft light shielding film attached to the circuit film; the barricades are formed via punching the soft light shielding film.

In an embodiment of the invention, the keypad module further includes a frame structure disposed on the circuit film; the barricades are formed via punching an exterior finishing board.

In an embodiment of the invention, the keypad module further includes a frame structure disposed on the circuit film; the barricades are attached to the exterior finishing board.

In an embodiment of the invention, the keycap includes a top cover and a plurality of side walls connected to the top cover. The barricades respectively correspond to the side walls, and the height H1 of each of the barricades satisfies: $H1 \geq H2 - X * \tan\theta$, wherein H2 is a distance between the side wall corresponding to the barricades and the circuit film, X is a distance between a projection P1 of the barricades with respect to the circuit film and a projection P2 of the corresponding side wall with respect to the circuit film, and θ ranges from 0° to 60°.

In an embodiment of the invention, the θ ranges from 30° to 60°.

In an embodiment of the invention, the keycap moves between an initial position and a pressing position; the distance between each of the barricades and the top cover is larger than or equal to a distance difference between the initial position and the pressing position.

In an embodiment of the invention, the height of each of the barricades ranges from 0.5 mm to 1.2 mm.

In an embodiment of the invention, the thickness of each of the barricades ranges from 0.1 mm to 0.2 mm.

In summary, in the keypad module of the invention, with the configuration that the barricades are disposed upright on the circuit film, surround the switch and located in a range covered by the keycap, the possibility that the light is leaked from the gap between the side wall of the keycap and the circuit film can be reduced, thereby effectively solving the light leakage problem.

In order to make the aforementioned features and advantages of the disclosure more comprehensible, embodiments accompanying figures are described in detail below.

DESCRIPTION OF EMBODIMENTS

Figure 1:
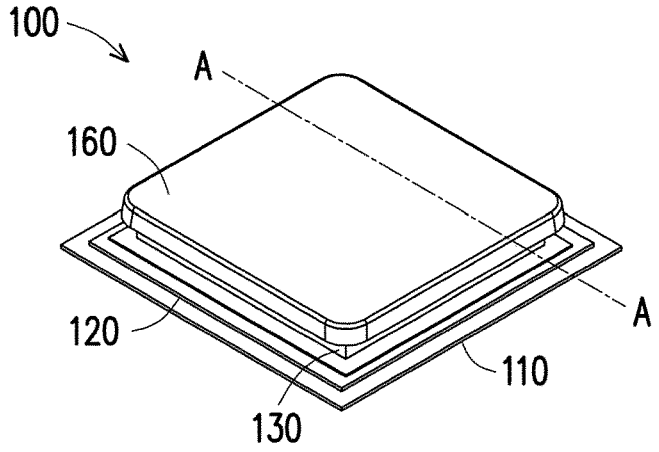
FIG. 1 is a schematic view of a keypad module according to an embodiment of the invention.
Figure 2:
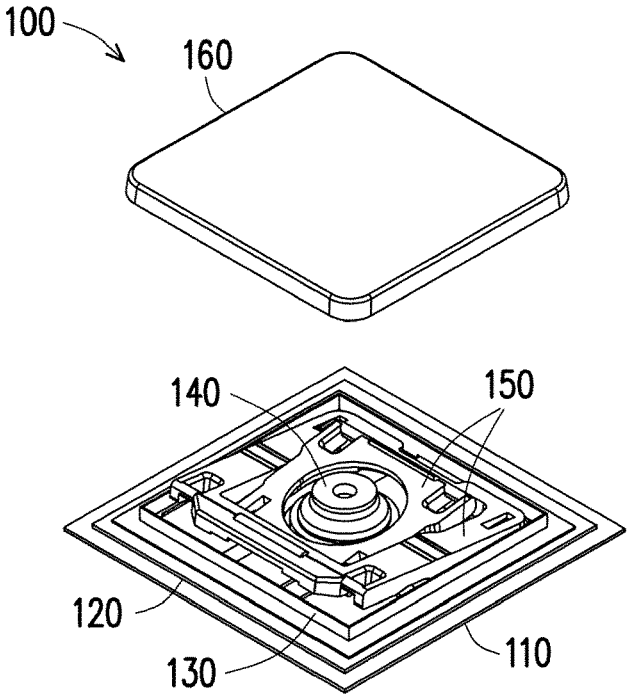
FIG. 2 is a schematic view illustrating that a keycap moves upward from the keypad module in FIG. 1.
Figure 3:
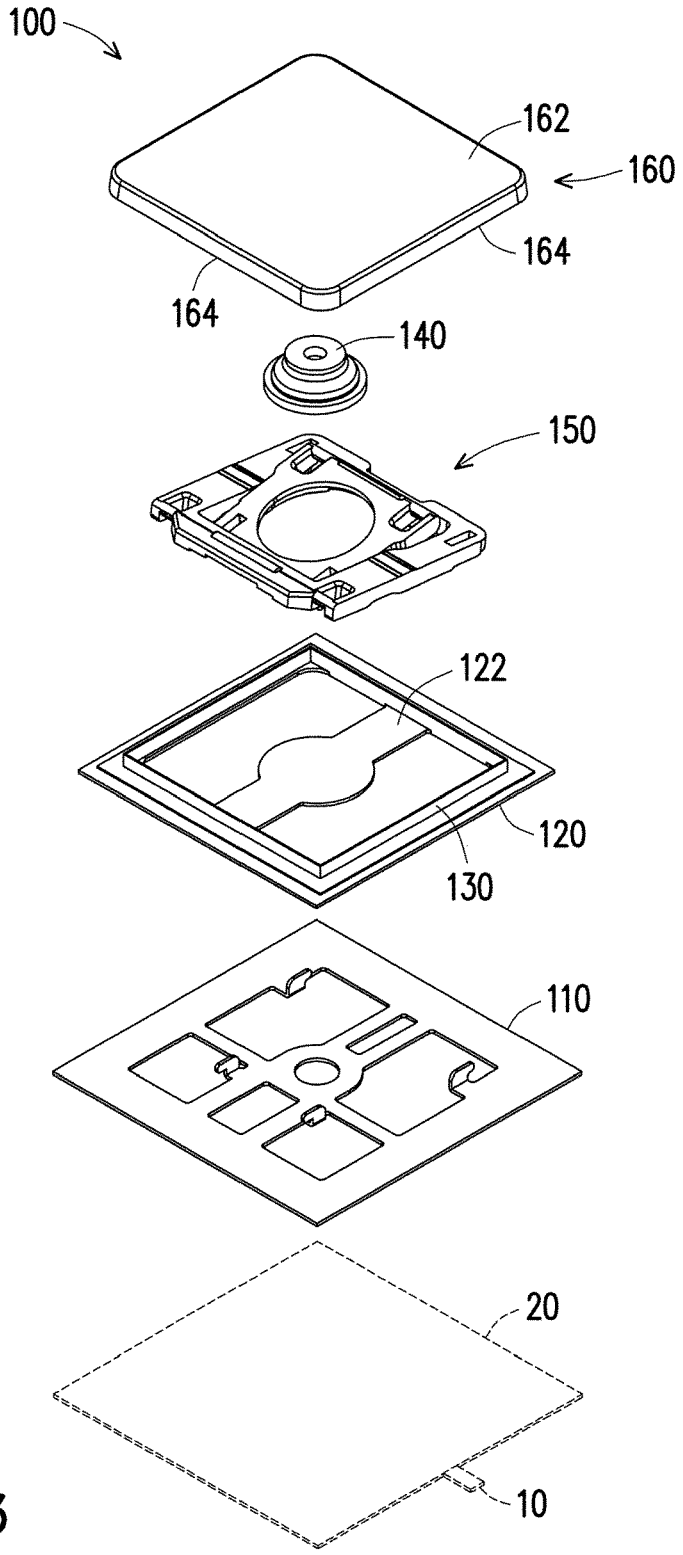
FIG. 3 is a schematic explosive view of a light-emitting element and the keypad module in FIG. 1.

FIG. 1 is a schematic view of a keypad module according to an embodiment of the invention. FIG. 2 is a schematic view illustrating that a keycap moves upward from the keypad module in FIG. 1. FIG. 3 is a schematic explosive view of a light-emitting element and the keypad module in FIG. 1. It should be indicated that, in the embodiment, a keypad module 100 is exemplified as a light-emitting keypad module. FIG. 3 schematically illustrates the light-emitting element in dash lines under the keypad module 100. The light-emitting element, for example, includes a light-emitting element 10 and a light-guide plate 20 so as to schematically illustrate a relative relationship between the light-emitting element and the keypad module 100. Certainly, the configuration relationship between the keypad module 100 and the light-emitting element as well as the type of the light-emitting element are not limited to the illustration in FIG. 3.

Referring to FIG. 1 to FIG. 3, the keypad module 100 in the embodiment includes a bottom plate 110, a circuit film 120, a plurality of barricades 130, an elastic body 140, a scissor structure 150 and a keycap 160. The circuit film 120 is disposed on the bottom plate 110 and includes a switch 122. The barricades 130 are disposed upright on the circuit film 120 and surround the switch 122. In the embodiment, the keypad module 100 includes four barricades 130; however, the invention provides no limitation to the number of the barricades 130.

The elastic body 140 is disposed on the switch 122. The elastic body 140 may be a metal dome, a rubber dome, a magnetic actuator or any element that can provide a pressing touch and restore the keycap 160. The scissor mechanism 150 is fixed on the bottom plate 110 and disposed at a position close to the switch 122 on the circuit film 120 so as to enable the keycap 160 to move upward and downward stably.

The keycap 160 is fixed on the scissor mechanism 150, and the keycap 160 covers the switch 122, the elastic body 140, the scissor mechanism 150 and the barricades 130. The keycap 160 includes a top cover 162 and a plurality of side walls 164 connected to the top cover 162. In the embodiment, the keycap 160 includes four side walls 164. The fourth barricades 130 respectively correspond to the four side walls 164. However, in other embodiment, the invention provides no particular limitation to the corresponding relationship between the barricades 130 and the side wall 164.

In the embodiment, the keypad module 100 is provided with the configuration that the barricades 130 are disposed on the circuit film 120, and the position at which the barricades 130 are disposed on the circuit film 120 is slightly retracted to the side wall 164 of the keycap 160 such that the top cover 162 of the keycap 160 can cover the barricades 130. In this manner, the barricades 130 are not directly seen from the appearance of the keypad module 100, and the keypad module 100 has an appearance similar to conventional keypad module.

FIG. 3 shows that a portion of the light emitted by the light-emitting element 10 can be transmitted to a light transmitting portion (not shown) on the keycap 160 to be emitted from the keycap 160 via the light-guide plate 20, a hole on the bottom plate 110, a hole on the circuit film 120 and a gap between the scissor mechanism 150 and the elastic body 140. In the conventional keypad module, a portion of the light that is emitted from the light-emitting element is leaked from the light-guide plate, the hole on the bottom plate, the hole on the circuit film and the gap between the side wall of the keycap and the circuit film. However, in the keypad module 100 of the embodiment, the barricades 130 can cover the portion of the light so as to avoid that the light is leaked from the gap between the side wall 164 of the keycap 160 and the circuit film 120, thereby effectively solving the light leakage problem.

It should be mentioned that, the embodiment simply illustrates a single keycap 160 and the corresponding switch 122, the elastic body 140, the scissor mechanism 150 and the barricades 130. However, in the keypad module 100, the number of the keycap 160 and the corresponding switch 122, the elastic body 140, the scissor mechanism 150 and the barricades 130 may be plural; the invention provides no limitation thereto. For example, the keypad module 100 may be disposed in the same manner as a keyboard.

In addition, generally speaking, when the user uses the keypad module 100, the user's sight is laid on a position obliquely above the keypad module 100 instead of being parallel with the keypad module 100. Therefore, the leaking light that is seen from the user's view is generally the light that is emitted toward the direction obliquely above the gap between the side wall 164 of the keycap 160 and the circuit film 120. Therefore, if the light that is emitted toward the direction obliquely above the gap between the side wall 164 of the keycap 160 and the circuit film 120 can be blocked, the light leakage that causes discomfort to the user's eyes can be solved. In other words, in some embodiments, although the height H1 (shown in FIG. 4) of the barricades 130 may be the same as or larger than the size of the gap between the side wall 164 of the keycap 160 and the circuit film 120, in some embodiments, the height H1 of the barricades 130 may not be the same as or larger than the size of the gap between the side wall 164 of the keycap 160 and the circuit film 120. The height H1 of the barricades 130 may be set to be any value as long as the user at the position obliquely above the keycap module 100 does not see the leaking light when looking at the direction of the keypad module 100.

Figure 4:
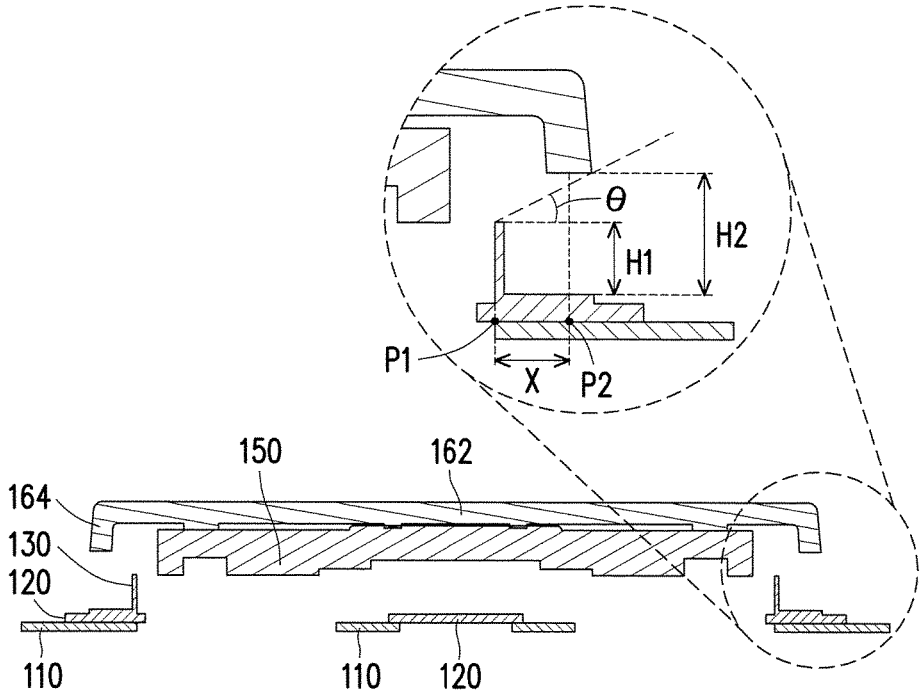
FIG. 4 is a cross-sectional view of the keycap of the keypad module in an initial position in FIG. 1 taken along line A-A.
Figure 5:
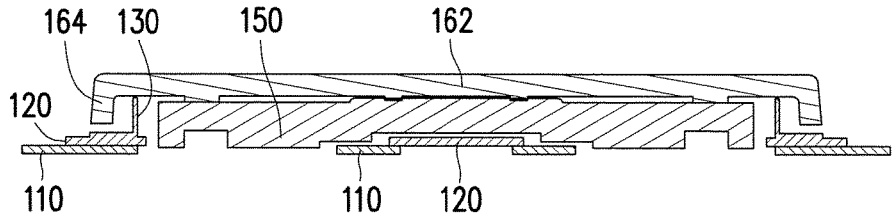
FIG. 5 is a schematic view illustrating that the keycap of the keypad module in FIG. 4 moves to a pressing position.

FIG. 4 is a cross-sectional view of the keycap of the keypad module in an initial position in FIG. 1 taken along line A-A. FIG. 5 is a schematic view illustrating that the keycap of the keypad module in FIG. 4 moves to a pressing position. It should be indicated that, in FIG. 4 and FIG. 5, in order to illustrate the barricades 130 clearly, only the elements on the cross-section taken along line A-A are illustrated; the elements that are not on the cross-section are not shown.

Referring to FIG. 4, in the embodiment, the height H1 of the barricades 130 satisfies $H1 \geq H2 - X * \tan\theta$, wherein H2 is a distance between the side wall 164 corresponding to the barricades 130 and the circuit film 120, X is a distance between a projection P1 of the barricades 130 with respect to the circuit film 120 and a projection P2 of the corresponding side wall 164 with respect to the circuit film 120, and θ ranges from no 60°. More specifically, θ ranges from 30° to 60°, and θ is approximately an oblique angle between the user's eyes and the keypad module 100.

In the embodiment, as long as the height H1 of the barricades 130 satisfies the above-mentioned relationship, the possibility that the user at the position obliquely above the keypad module 100 sees the leaking light when looking at the direction of the keypad module 100 can be effectively reduced. In addition, in order to avoid that the height H1 of the barricades 130 is over high and interferes the movement of the keycap 160, in the embodiment, the distance between each of the barricades 130 and the top cover 162 is larger than or equal to a distance difference between the initial position (shown in FIG. 4) and the pressing position (shown in FIG. 5) so there is sufficient space for the keycap 160 to move.

Certainly, the invention provides no limitation to the relationship of the height H1 of the barricades 130. In terms of the keypad module 100 on conventional keyboard, the designer may directly set the height H1 of the barricades 130 to range from 0.5 mm to 1.2 mm, which can also effectively reduce the possibility that the user sees leaking light. Certainly, the designer may adjust the height range and proportional relationship of the barricades 130, the invention provides no limitation thereto.

In addition, in the embodiment, the thickness of the barricades 130 is exemplified in a range between 0.1 mm to 0.2 mm so that the structure of the barricades 130 can be configured upright stably in a limited space of the keycap 160, and the thickness thereof is sufficient to cover the light. Similarly, the thickness of the barricades 130 is not limited thereto.

As shown in FIG. 4, in the embodiment, the barricades 130 are a portion of the circuit film 120. In other words, the barricades 130 are formed by punching the circuit film 120, and the barricades 130 and the circuit film 120 are formed integrally. Therefore, in the embodiment, a portion of the circuit film 120 serves as the switch 122 and the circuit electrically connected to the switch 122, and another portion of the circuit film 120 is used for punching the barricades 130, which is a simple structure. Certainly, the embodiment simply serves to illustrate a form of the barricades 130, and the form of the barricades 130 is not limited thereto.

Figure 6:
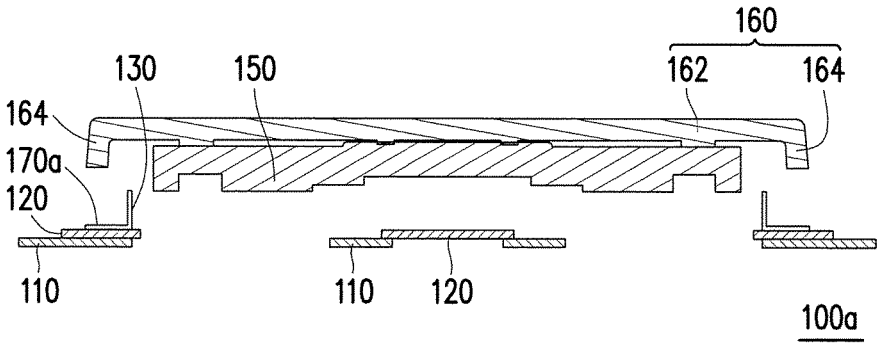
FIG. 6 to FIG. 8 are cross-sectional views of a plurality of keypad modules according to other embodiment of the invention.
Figure 7:
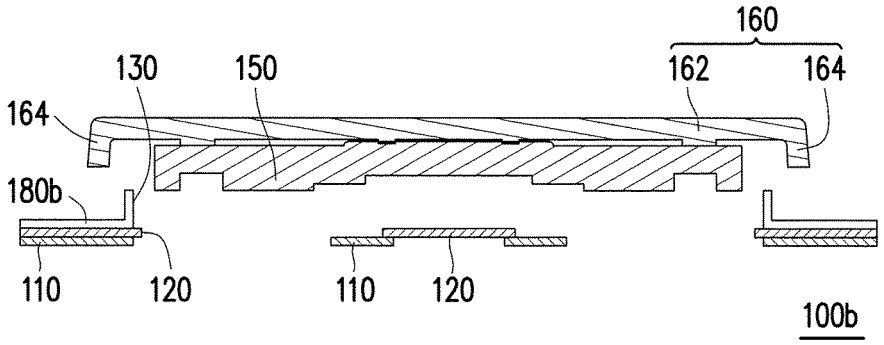
Figure 8:
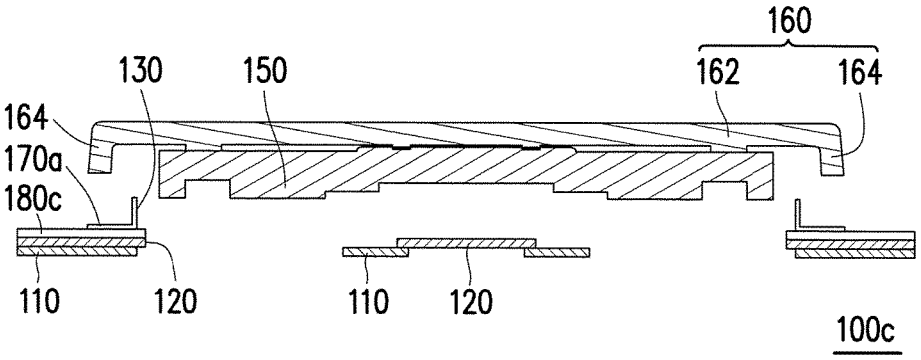

FIG. 6 to FIG. 8 are cross-sectional views of a plurality of keypad modules according to other embodiments of the invention. It should be indicated that, in the following embodiments, the elements that are the same as or similar to those used in the previous embodiment are denoted by the same or similar reference numerals; no further descriptions are incorporated herein. The following paragraphs mainly discuss the differences between embodiments.

Referring to FIG. 6 first, the major difference between a keypad module 100*a* in FIG. 6 and the keypad module 100 in FIG. 4 is that, in the embodiment, the keypad module 100*a* further includes a soft light shielding film 170*a*. The soft light shielding film 170*a* is exemplified as a MYLAR, and the material thereof is a polyester resin which can be easily punched to form a particular shape and provides a certain degree of supporting force. In the embodiment, by punching to form the barricades 130 on the soft light shielding film 170*a*, and the soft light shielding film 170*a* is attached to the circuit film 120, the barricades 130 that is established upright on the circuit film 120 can be formed, and the fabrication process is simple.

Referring to FIG. 7, the major difference between a keypad module 100*b* in FIG. 7 and the keypad module 100 in FIG. 4 is that, in the embodiment, the keypad module 100*b* further includes a frame structure 180*b* disposed on the circuit film 120. The barricades 130 are formed by punching the frame structure 180*b*. In other words, in the embodiment, the fabrication method of the keypad module 100*b* is to punch the frame structure 180*b* or inject the barricades 130, and then the frame structure 180*b* is assembled on the circuit film 120. In the embodiment, the frame structure 180*b* is exemplified as an exterior finishing board. The frame structure 180*b* not only has a decorative effect, and the barricades 130 thereof also cover the leaking light, and thus a good visual effect can be provided. Certainly, the invention provides no limitation to the type of the frame structure 180*b*.

Referring to FIG. 8, the major difference between a keypad module 100*c* in FIG. 8 and the keypad module 100*b* in FIG. 7 is that, in the embodiment, the barricades 130 are, for example, formed on the soft light shielding film 170*a* first as shown in FIG. 6. In other words, for example, the barricades 130 are formed by punching on the soft light shielding film 170*a* first, and then the soft light shielding film 170*a* having the barricades 130 is attached to the frame structure 180*c*, unlike in FIG. 7 in which the barricades 130 are formed by a portion of the frame structure 180*b*. It should be mentioned that a plurality of focus of the barricades 130 are described above, but the form of the barricades 130 are not limited thereto. The barricades 130 fall within the scope claimed by the invention as long as the barricades can reduce the possibility that the light is leaked from the gap between the side wall 164 of the keypad 160 and the circuit film 120.

In summary, in the keypad module of the invention, with the configuration that the barricade is established upright on the circuit film, surrounds the switch and located within a range covered by the keycap, the possibility that light is leaked from the gap between the side wall of the keycap and the circuit film can be reduced, thereby effectively solving the light leakage problem. In addition, the height H1 of the barricades satisfies $H1 \geq H2 - X * \tan\theta$, wherein H2 is a distance between the side wall corresponding to the barricades and the circuit film, X is a distance between the projection P1 of the barricades with respect to the circuit film and the projection P2 of the corresponding side wall with respect to the circuit film; in this manner, the possibility that the user (at the position obliquely above the keypad module) sees the leaking light when looking at the direction of the keypad module can be effectively reduced.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. A keypad module, comprising:

a bottom plate;

a circuit film, disposed on the bottom plate and comprising a switch;

a barricade, disposed upright on the circuit film and surrounding the switch;

an elastic body, disposed on the switch;

a scissor mechanism, fixed on the bottom plate and disposed at a position close to the switch on the circuit film; and a keycap, fixed on the scissor mechanism and covering the switch, the elastic body, the scissor mechanism and the barricade, wherein the keycap comprises a top cover and a plurality of side walls connected to the top cover, the keycap moves between an initial position and a pressing position, and when the keycap is at the initial position, a distance between the barricade and the top cover is larger than or equal to a distance difference between the initial position and the pressing position.

2. The keypad module according to claim 1, wherein the barricade are formed by punching the circuit film to be formed integrally with the circuit film.

3. The keypad module according to claim 1, further comprising:

a soft light shielding film, attached to the circuit film, the barricade being formed by punching the soft light shielding film.

4. The keypad module according to claim 1, further comprising:

a frame structure, disposed on the circuit film, the barricade being formed by punching or injecting the frame structure.

5. The keypad module according to claim 1, further comprising:

a frame structure, disposed on the circuit film, the barricade being attached to the frame structure.

6. The keypad module according to claim 1, wherein a height of the barricade ranges from 0.5 mm to 1.2 mm.

7. The keypad module according to claim 1, wherein a thickness of the barricade ranges from 0.1 mm to 0.2 mm.

8. The keypad module according to claim 1, wherein the barricade respectively correspond to the side walls, a height H1 of the barricade satisfies $H1 \geq H2 - X * \tan\theta$, wherein H2 is a distance between the side wall corresponding to the barricade and the circuit film, X is a distance between a projection P1 of the barricade with respect to the circuit film and a projection P2 of the corresponding side wall with respect to the circuit film, and θ ranges from 0° to 60°.

9. The keypad module according to claim 8, wherein θ ranges from 30° to 60°.

* * * * *